US012195932B2

(12) United States Patent
Ulmer et al.

(10) Patent No.: US 12,195,932 B2
(45) **Date of Patent: *Jan. 14, 2025**

(54) MODULAR CONCRETE SCREED SYSTEM

(71) Applicant: Curb Roller LLC, Fairview, KS (US)

(72) Inventors: Seth Nathaniel Ulmer, Bern, KS (US); John Allen Armstrong, Fairview, KS (US); Kenneth A. Pyle, Hiawatha, KS (US)

(73) Assignee: Curb Roller LLC, Fairview, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/360,913

(22) Filed: Jul. 28, 2023

(65) Prior Publication Data

US 2023/0366158 A1 Nov. 16, 2023

Related U.S. Application Data

(63) Continuation of application No. 17/314,641, filed on May 7, 2021, now Pat. No. 11,753,779.

(60) Provisional application No. 63/070,067, filed on Aug. 25, 2020.

(51) Int. Cl.
*E01C 19/24* (2006.01)
*E01C 19/23* (2006.01)

(52) U.S. Cl.
CPC ..... *E01C 19/236* (2013.01); *E01C 19/24* (2013.01); *E01C 2301/14* (2013.01)

(58) Field of Classification Search
CPC ..... E01C 19/236; E01C 19/24; E01C 2301/14
USPC ..... 404/103, 132
See application file for complete search history.

(56) References Cited

U.S. PATENT DOCUMENTS

| | | | | |
|---|---|---|---|---|
| 1,104,502 | A * | 7/1914 | Hist | E01C 19/26 172/350 |
| 7,997,826 | B2 * | 8/2011 | Dufty | A01B 29/02 404/125 |
| 8,137,026 | B2 * | 3/2012 | Lura | E04G 21/10 404/118 |
| 2004/0131419 | A1 * | 7/2004 | Hammond | E04F 21/241 403/298 |
| 2006/0251475 | A1 * | 11/2006 | Lindley | E01C 19/29 404/118 |
| 2020/0071890 | A1 * | 3/2020 | Pyle | E01C 19/201 |

* cited by examiner

*Primary Examiner* — Raymond W Addie
(74) *Attorney, Agent, or Firm* — Hovey Williams LLP

(57) ABSTRACT

A concrete screed assembly broadly includes a plurality of elongated drum sections. The drum sections are interchangeably interconnectable in an end-to-end relationship to cooperatively form a rotatable concrete screed drum that is selectively variable depending on the drum sections interconnected to form the drum. The drum sections each present a concrete-forming outer surface configured to engage concrete as the drum is rotated. The drum sections each include opposite connection ends.

25 Claims, 10 Drawing Sheets

MODULAR CONCRETE SCREED SYSTEM

CROSS-REFERENCE TO RELATED APPLICATIONS

This is a continuation of U.S. application Ser. No. 17/314,641, filed May 7, 2021, entitled MODULAR CONCRETE SCREED SYSTEM, which application claims the benefit of U.S. Provisional Application Ser. No. 63/070,067, filed Aug. 25, 2020, entitled MODULAR CONCRETE SCREED SYSTEM, which is hereby incorporated in its entirety by reference herein.

BACKGROUND

1. Field

The present invention relates generally to concrete equipment used for forming, grading, or screeding concrete. In particular, embodiments of the present invention concern a modular concrete screed system having a screed drum with interchangeable drum sections.

2. Discussion of Prior Art

Various types of concrete structures, such as slabs, walkways, and walls, are conventionally graded, formed, and/or finished to present an exposed surface with a desired grade and surface texture. In the usual manner, forms are erected to define boundaries of the concrete structure and may serve as a guide for grading, forming, and/or finishing the exposed surface.

Powered concrete forming tools have long been available to form, float, or trowel a poured concrete area. Among conventional forming tools, powered concrete screeds are known to include a power source and an elongated concrete-forming drum that is rotatable by the power source to form concrete. In known embodiments, the rotatable drum may have a tubular body that extends continuously from one end of the drum to the other end to define a concrete-forming surface. In other prior art embodiments, the rotatable drum may have detachable drum sections connected in series to cooperatively form a concrete-forming surface of the drum.

Prior art concrete-forming drums for screeds have several deficiencies. For instance, continuous rotatable drums are notorious for being excessively long and cumbersome to move. Due to the length of continuous rotatable drums, transportation of the drum is generally expensive (transportation costs may be more than the cost of the drum itself) and difficult. Furthermore, continuous drums may be easily damaged if dropped or otherwise mishandled.

For prior art drums having detachable drum sections, the drum may be assembled for use and later disassembled for transportation. However, prior art detachable drum sections are also problematic because assembly and disassembly are difficult and labor-intensive. For instance, assembly of detachable drum sections requires the use of specialized tools. Assembly of connections is also difficult for one person to perform.

This background discussion is intended to provide information related to the present invention which is not necessarily prior art.

SUMMARY

The following brief summary is provided to indicate the nature of the subject matter disclosed herein. While certain aspects of the present invention are described below, the summary is not intended to limit the scope of the present invention.

Embodiments of the present invention provide a concrete screed assembly that does not suffer from the problems and limitations associated with prior art devices, including those problems set forth above.

A first aspect of the present invention concerns a concrete screed assembly that broadly includes a plurality of elongated drum sections. The drum sections are interchangeably interconnectable in an end-to-end relationship to cooperatively form a rotatable concrete screed drum being selectively variable depending on the drum sections interconnected to form the drum. The drum sections each present a concrete-forming outer surface configured to engage concrete as the drum is rotated. The drum sections each include opposite connection ends that are similarly constructed, such that each connection end of one of the drum sections is operable to interconnect with either of the connection ends of any of the other the drum sections.

A second aspect of the present invention concerns a concrete screed assembly that broadly includes a plurality of elongated drum sections and a plurality of fasteners. The drum sections are interconnectable in an end-to-end relationship to cooperatively form a rotatable concrete screed drum being selectively variable depending on the drum sections interconnected to form the drum. The drum sections each present a concrete-forming outer surface configured to engage concrete as the drum is rotated. The drum sections each include opposite connection ends, such that an adjacent pair of drum sections forming at least part of the drum present interconnected connection ends. The interconnected connection ends each include a plurality of fastener pockets recessed radially inward relative to the outer surface of the respective drum section. The fasteners interconnect the connection ends of the adjacent drum sections. Each of the fasteners extends into corresponding ones of the pockets of the interconnected connection ends.

A third aspect of the present invention concerns an interchangeable drum section interconnectable in an end-to-end relationship with other interchangeable drum sections to cooperatively form a rotatable concrete screed drum selectively variable depending on the drum sections interconnected to form the drum. The interchangeable drum section broadly includes an elongated drum body presenting a concrete-forming outer surface configured to engage concrete as the drum is rotated. The body includes opposite connection ends that are similarly constructed, such that each connection end is operable to interconnect with either of the connection ends of the other drum sections. The drum body presents a central rotational axis. The connection ends include respective alignment elements. Each alignment element is configured to at least in part cooperate with an alignment element of one of the other drum sections to align the rotational axes of interconnected drum sections, such that the drum has a common axis of rotation.

A fourth aspect of the present invention concerns a drum section interconnectable in an end-to-end relationship with other drum sections to cooperatively form a rotatable concrete screed drum selectively variable depending on the drum sections interconnected to form the drum. The drum section broadly includes an elongated drum body presenting a concrete-forming outer surface configured to engage concrete as the drum is rotated. The drum body includes opposite connection ends. Each of the connection ends includes a plurality of fastener pockets recessed radially inward relative to the outer surface, such that corresponding pockets of interconnected adjacent drum sections of the drum are configured to receive a fastener interconnecting the adjacent drum sections.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a side perspective of a concrete screed assembly constructed in accordance with a preferred embodiment of the present invention, showing a power unit, a screed handle, and a rotatable concrete screed drum, with the power unit being swung into in an advancement position in which the power unit is angled to one side of the drum for advancement of the concrete screed along an area of poured concrete;

Figure 1:
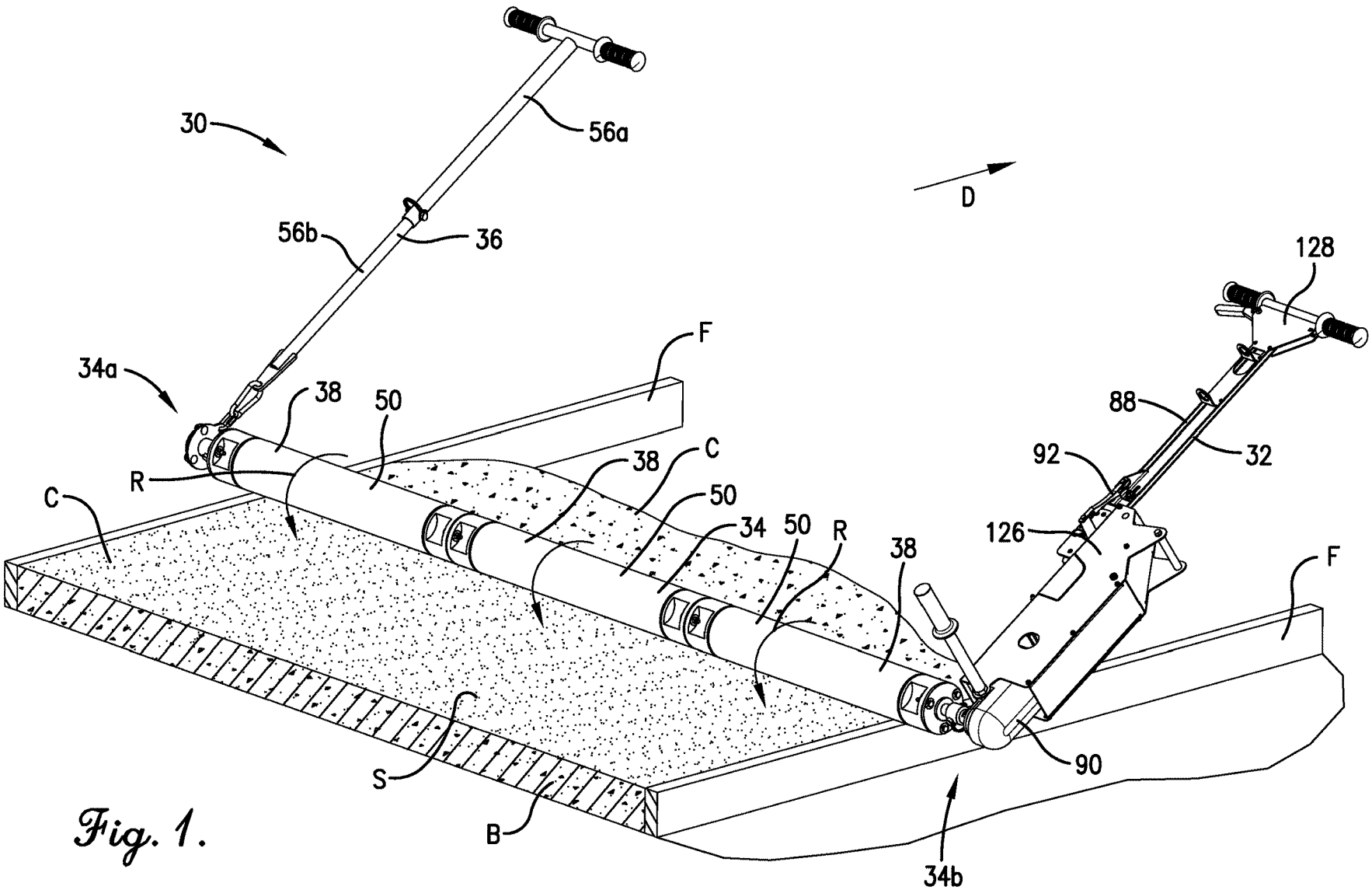

The drawing figures do not limit the present invention to the specific embodiments disclosed and described herein. While the drawings do not necessarily provide exact dimensions or tolerances for the illustrated components or structures, the drawings, not including any purely schematic drawings, are to scale with respect to the relationships between the components of the structures illustrated therein.

DETAILED DESCRIPTION OF THE PREFERRED EMBODIMENTS

Figure 2:
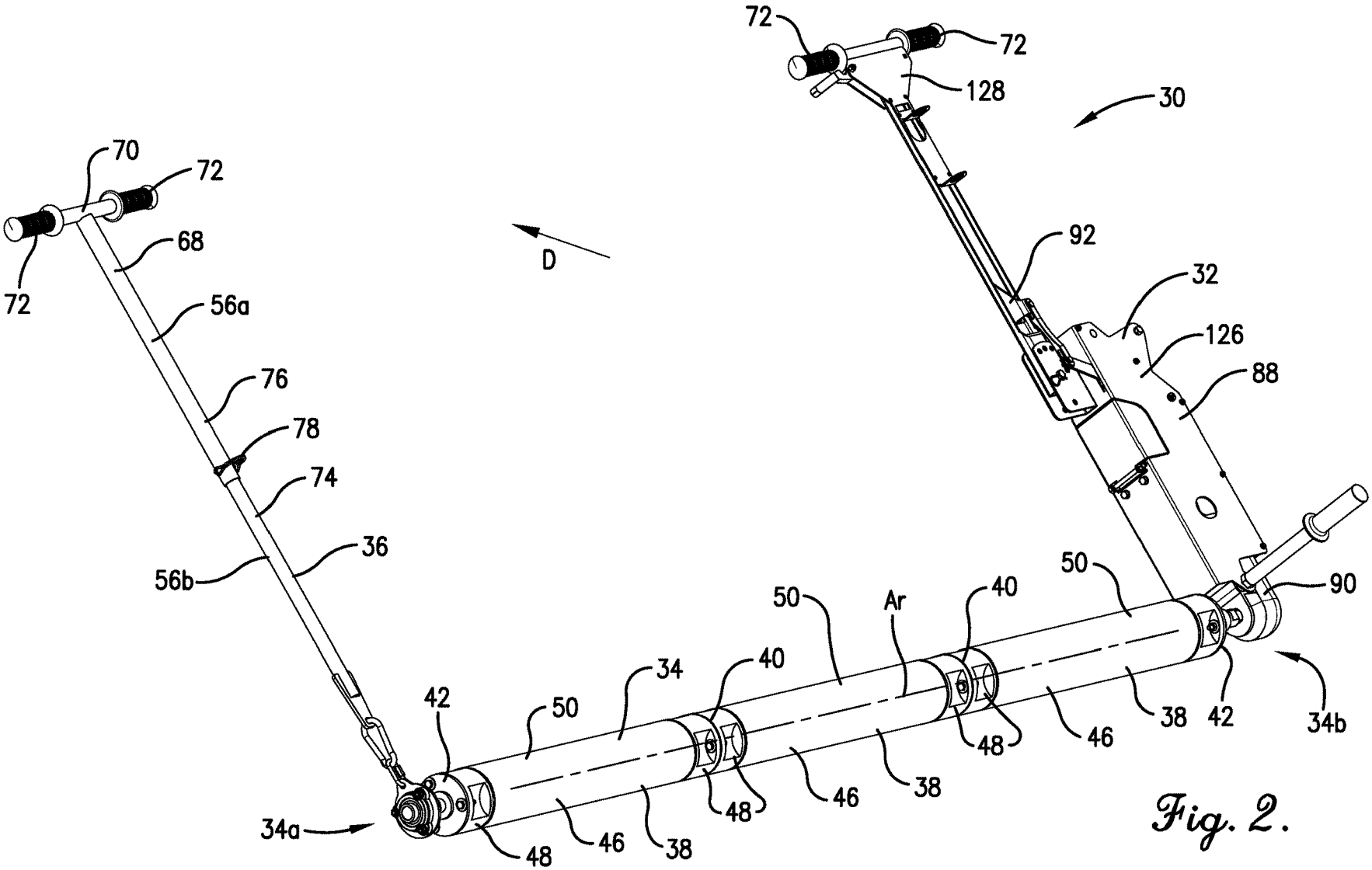
FIG. 2 is a side perspective of the concrete screed assembly similar to FIG. 1, but showing the concrete screed assembly from the opposite end of the drum assembly, with the power unit including a frame and a powered drive, and showing drum sections of the drum attached end-to-end.
Figure 3:
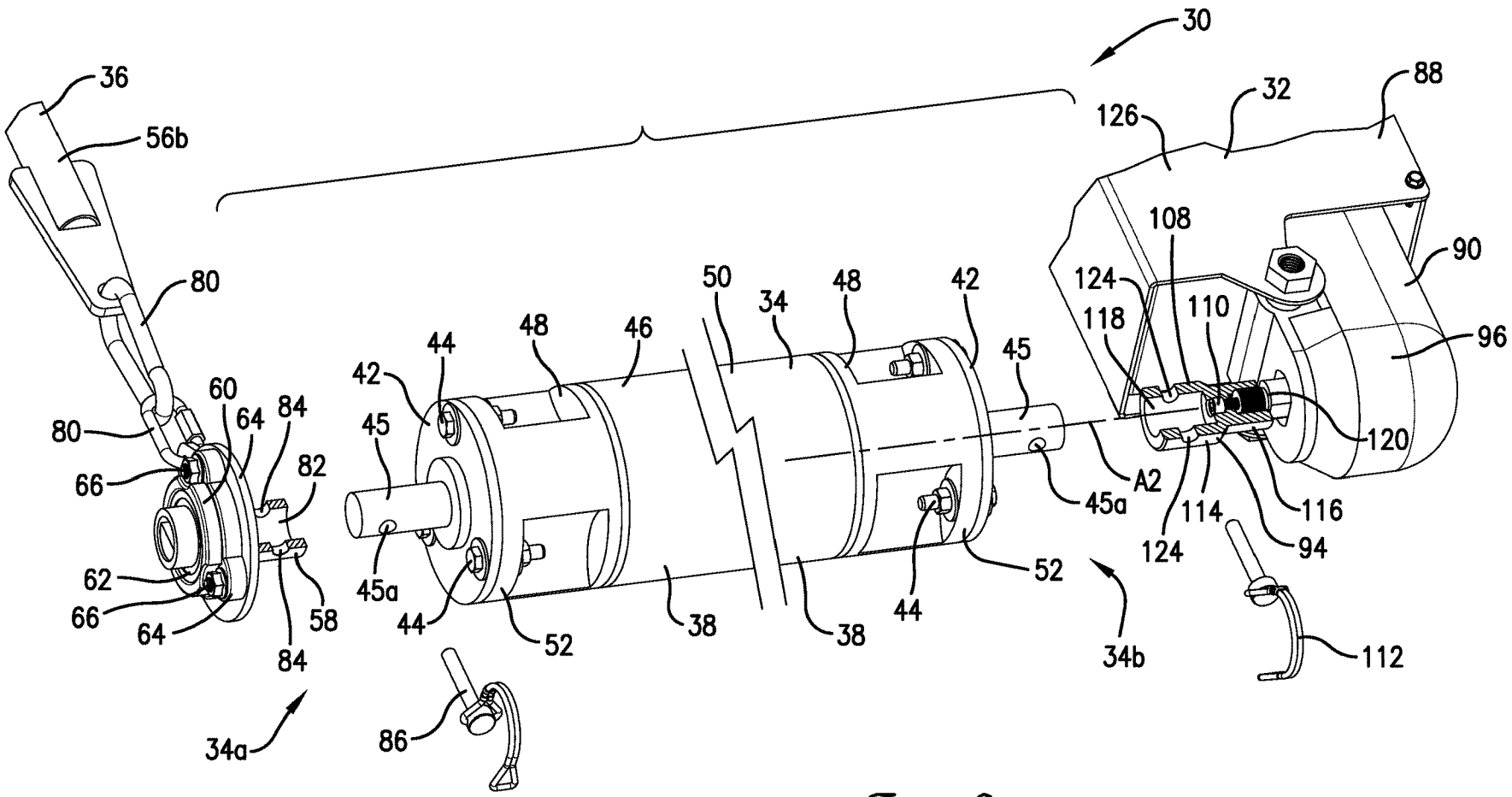
FIG. 3 is an enlarged fragmentary perspective of the concrete screed assembly shown in FIGS. 1 and 2, showing the power unit and screed handle exploded away from the respective drum ends of the drum.
Figure 4:
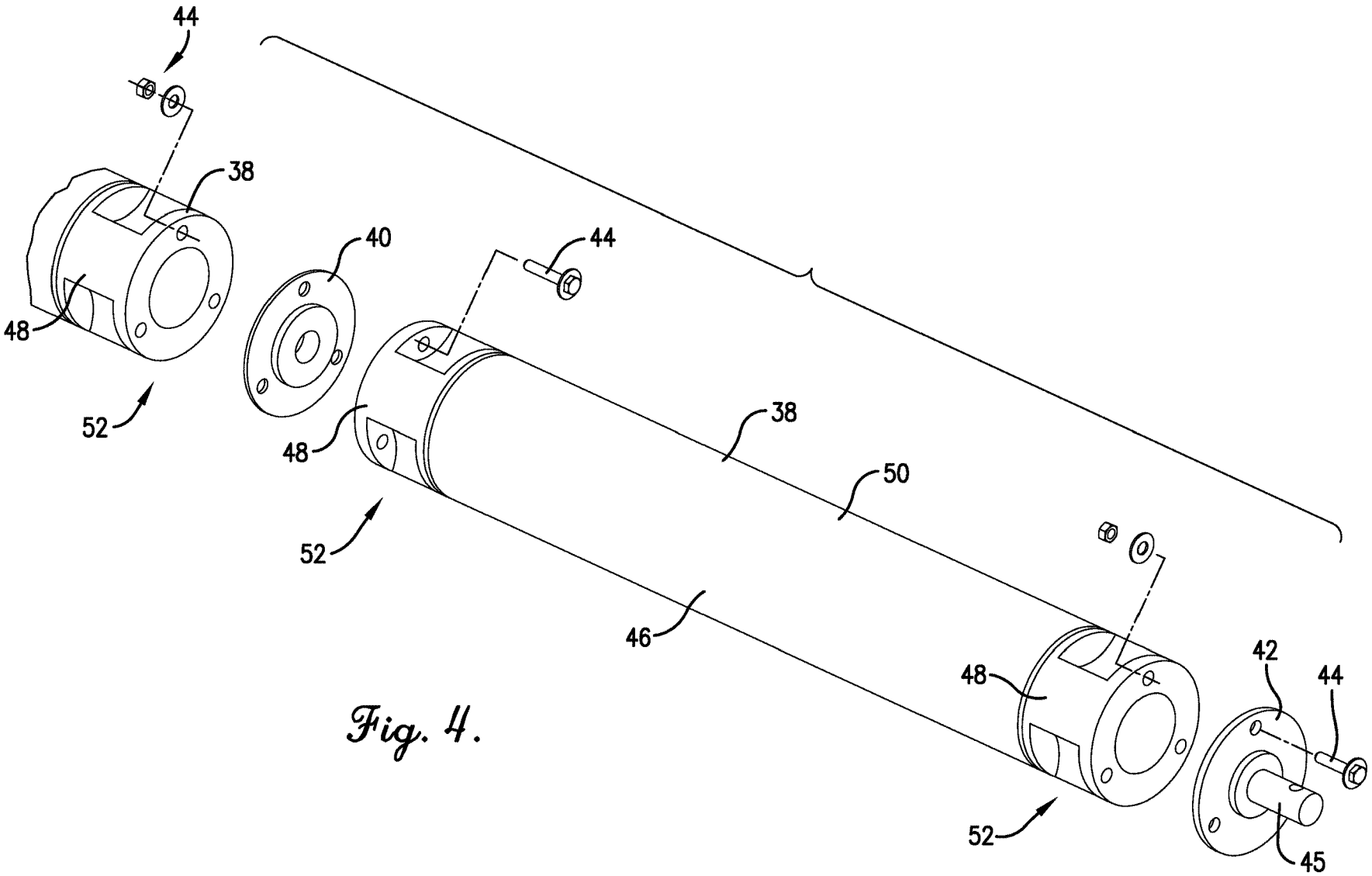
FIG. 4 is an exploded fragmentary perspective of the drum shown in FIGS. 1-3, showing a pair of drum sections, an interconnecting adapter facilitating removable attachment of the drum sections to each other, and an end adapter.

Turning to FIGS. 1-3, a powered concrete screed assembly 30 is configured to be manually advanced in a forward direction D along poured concrete C (see FIG. 1). Concrete forms F are constructed to define a space to receive the poured concrete C. The concrete forms F hold the poured concrete C within the space as the concrete is graded and finished to form a concrete slab B with a formed surface S.

In the usual manner, the concrete screed assembly 30 is pulled forwardly across the concrete area to screed the poured concrete C and grade the formed surface S. Concrete screed assembly 30 includes a power unit 32 that drives a rotatable concrete screed drum 34. As the concrete screed assembly 30 is advanced forwardly to grade the surface S, the drum 34 rotates in rotation direction R so that excess concrete along the drum 34 is directed forwardly ahead of the drum 34 (see FIG. 1).

During operation, it will be understood that the concrete screed assembly 30 can be used to remove excess concrete material. For example, the concrete screed assembly 30 can remove excess concrete from an area where the poured concrete C is above a desired grade level. In the depicted embodiment, the desired grade level is defined by an upper edge of the forms F. Preferably, the drum 34 rests on the upper edge of the forms F during screed advancement to grade the formed surface S at the desired grade level.

The concrete screed assembly 30 can also be used to transfer concrete from one area for use in another area. For instance, the concrete screed assembly 30 can transfer excess concrete to an area where the poured concrete C is below the desired grade level.

The formed surface S of the depicted concrete slab B is generally flat (i.e., planar) and level relative to a horizontal plane. It will also be appreciated that the concrete screed assembly 30 can be used to grade the surface of a concrete slab so that the surface is flat (i.e., planar) and sloped relative to the horizontal plane. For instance, one of the concrete forms F could be positioned higher than the other concrete form F.

For certain aspects of the present invention, the concrete screed could be configured to form a graded surface that is not flat. For instance, the formed surface could be shaped to include a convex shape and/or a concave shape. In alternative embodiments, the formed surface may be shaped so that the graded concrete forms at least part of another type of concrete structure (e.g., a walkway, wall, drainage ditch, or curbing).

The concrete screed assembly 30 broadly includes the power unit 32, the rotatable concrete screed drum 34, and a screed handle 36.

Rotatable Concrete Screed Drum

Turning to FIGS. 1-5, the drum 34 is operable to be rotated by the power unit 30. While being rotated, drum 34 is configured to engage concrete along the length of the drum 34 and direct at least some concrete forwardly ahead of the drum 34. The illustrated drum 34 presents opposite drum ends 34*a,b*.

As will be explained, the drum 34 also preferably includes drum sections 38, interconnecting adapters 40 located between adjacent drum sections 38, end adapters 42, and fasteners 44. The end adapters 42 each include a connection shaft 45 that presents a transverse hole 45*a* (see FIGS. 4 and 7).

The preferred drum sections 38 are interchangeably interconnectable in an end-to-end relationship to cooperatively form the drum 34. The illustrated drum 34 is selectively variable depending on the drum sections 38 interconnected to form the drum 34. Drum sections 38 forming the drum 34 are each operable to engage the poured concrete C as the drum 34 is rotated to form the graded surface S. In the preferred embodiment, each of the drum sections 38 forming the drum 34 have a concrete-forming outer surface 50 to engage concrete as the drum 34 is rotated. Each drum section 38 presents a central rotational axis A1 (see FIG. 5).

However, it is within the scope of the present invention for alternative drum embodiments to include a drum section (or other drum element) located along the length of the drum that does not form concrete as the drum is rotated. That is, an alternative drum may be provided with one or more alternative drum sections that do not present a concrete-forming outer surface. For instance, alternative drum embodiments may include one or more spacer elements to connect concrete-forming drum sections and space such concrete-forming drum sections apart.

As will be explained, the depicted drum sections 38 each preferably include an elongated drum tube 46 and drum connectors 48. The drum tube 46 and drum connectors 48 cooperatively present a drum body having a concrete-forming outer surface 50. Drum connectors 48 preferably define respective connection ends 52 of the drum section 38 (see FIGS. 4 and 5). The illustrated drum tube 46 comprises a unitary cylindrical tube and presents opposite tube ends 53 and a continuous tube bore 54 extending between the tube ends 53 (see FIGS. 7 and 8).

As will also be described in the preferred embodiment, the opposite connection ends 52 are similarly constructed, such that each connection end 52 of one of the drum sections 38 is operable to interconnect with either of the connection ends 52 of any of the other the drum sections 38. However, certain aspects of the present invention contemplate drum sections that are not entirely interchangeable, as will be explained below.

Screed Handle and Power Unit

Turning again to FIGS. 1-3, the screed handle 36 is configured to position the drum 34 by moving the corresponding end adapter 42. The handle 36 includes telescopic proximal and distal handle sections 56*a,b*, a coupler shaft 58, bearing housing 60, and a bearing 62 that rotatably supports the coupler shaft 58 relative to the bearing housing 60.

Figure 6:
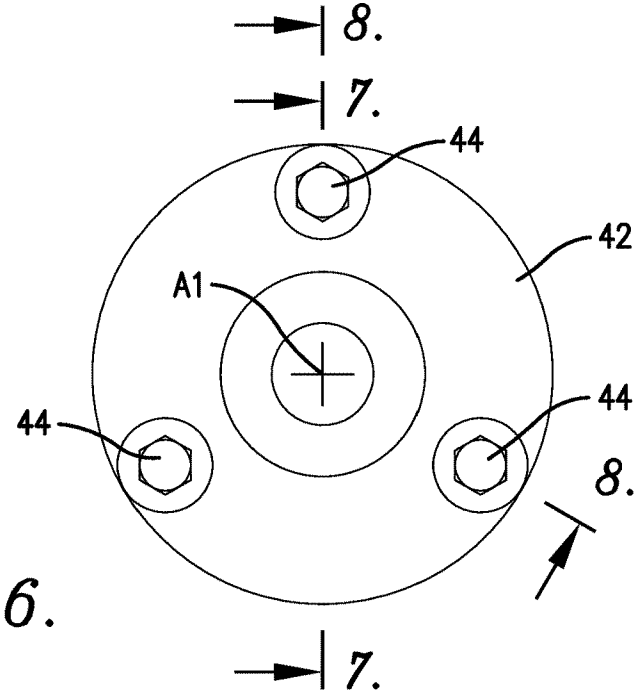
FIG. 6 is a fragmentary end elevation of the drum taken along line 6-6 in FIG. 5.

The housing 60 includes a pair of plates 64 and fasteners 66 (see FIG. 6). The plates 64 cooperatively receive the bearing 62 and the coupler shaft 58 and are removably secured to each other by the fasteners 66. Preferably, the coupler shaft 58 can spin freely relative to the bearing housing 60 and the rest of the handle 36.

The proximal handle section 56*a* includes a tubular body 68 and a transverse bar 70. The bar 70 is attached to a proximal end of the body and includes a pair of grips 72. The distal handle section 56*b* presents a proximal portion 74 that is telescopically received within a distal portion 76 of the proximal handle section 56*a* (see FIG. 2). The proximal and distal portions 74,76 can be selectively secured to one another with a pin 78. The pin 78 is removable to permit relative sliding and detachment of the sections 74,76. The bearing housing 60 is attached to a distal end of the distal handle section 56*b* with clips 80 (see FIG. 3). The clips 80 preferably allow the handle sections 56*a,b* to swing relative to the bearing housing 60.

The coupler shaft 58 presents a socket 82 and aligned fastener holes 84 (see FIG. 3). The socket 82 slidably receives the connection shaft 45 of the drum end 34*a*. A pin 86 is inserted through the holes 84 of the coupler shaft 58 and the hole 45*a* of the connection shaft 45 to removably attach the connection shaft 45 and coupler shaft 58 to one another (see FIG. 3).

When attached to the drum end 34*a*, the handle 36 is used to manually shift (e.g., pull) the drum end 34*a* (e.g., when advancing the screed 32 in the forward direction D). At the same time, the handle 36 permits the drum 34 to rotate relative to the handle 36. As will be explained, the power unit 30 rotatably drives the drum 34. Preferably, the handle 36 and the power unit 30 are cooperatively used to manually advance the drum 34 (for instance, when the screed 32 is being advanced/pulled in the forward direction D).

It is within the scope of the present invention for the screed handle to be alternatively constructed and/or attached relative to the drum end. For instance, the bearing housing and the distal handle section could be alternatively attached to one another (e.g., to permit relative swinging movement therebetween). As another example, the handle sections could be removed entirely (as well as even the coupler shaft, bearing, and bearing housing) and replaced with a simple slip rope coupled to the drum connection shaft.

Furthermore, for certain aspects of the present invention, the concrete screed may be devoid of the handle entirely. For instance, the drum could be supported only by the frame associated with the power unit. In such an alternative embodiment, the frame of the power unit may be configured for interchangeable attachment to both drum ends.

Still referring to FIGS. 1-3, the power unit 32 is drivingly connected to the drum 34 and is configured to rotate the drum 34. The power unit 32 also cooperates with the handle 36 to manually advance the drum 34 in the forward direction D. The power unit 32 broadly includes a frame 88, a powered drive 90, a mechanical control connection 92, and a drive coupler 94.

The powered drive 90 provides a motive power source to drive the drum 34. Among other things, the powered drive 90 includes a power tool case 96, an electric motor (not shown), a drive shaft 98, and a rechargeable battery (not shown).

The drive coupler 94 is configured to facilitate removable attachment of the power unit 32 to the drum 34 and to impart rotation of the drive shaft 98 to the drum 34. Drive coupler 94 is preferably configured to align the drive shaft 98 and the connection shaft 45 of the drum end 34*b* on a common rotational axis A2 without permitting off-axis swinging of the shafts 45,98 relative to one another.

The depicted drive coupler 94 includes a coupler body 108, a screw 110, and a removable pin 112 (see FIG. 3). The coupler body 108 is preferably a rigid and unitary structure and presents opposite connector portions 114,116 (see FIG. 3). The preferred connector portions 114,116 present respective sockets 118,120. The coupler body 108 also presents a bore extending axially between the sockets 118,120 so that the sockets 118,120 communicate with one another.

In the illustrated embodiment, the connector portion 114 presents the socket 118 to receive a corresponding part of the drive shaft 98. For some aspects of the present invention, the drive shaft may alternatively include a socket to receive the connector portion of the coupler body.

It is contemplated within certain aspects of the present invention for the connector portion 116 and/or the drive shaft 98 to include alternative complemental features that drivingly engage one another. For instance, the connector portion and drive shaft may include a drive connection formed by complemental slot and key features.

The connector portion 116 of the coupler body 108 presents the socket 120 and aligned fastener holes 124. The illustrated socket 120 includes a smooth bore and is configured to receive part of the connection shaft 45 of the drum end 34*b*. The socket 120 is coaxial with the rotational axis A2, and the fastener holes 124 extend transversely to the rotational axis A2.

The pin 112 of the drive coupler 94 is associated with the connector portion 116 to secure the connector portion 116 to the connection shaft 45 of the drum end 34*b*. Preferably, the pin 112 is removably inserted through the fastener holes 124 and hole 45*a* to drivingly engage the coupler body 108 and the connection shaft 45. The illustrated connector portion 116 and the connection shaft 45 are consequently attached relative to one another without permitting off-axis swinging therebetween.

It is also consistent with at least some aspects of the present invention for the coupler body and the connection shaft to be alternatively connected relative to one another. For instance, the coupler body and the connection shaft may be joined by a connection structure other than a pinned joint (e.g., a threaded joint and/or a joint with a key-and-slot configuration). Yet further, the connector portion and connection shaft may alternatively be constructed to prevent relative rotational movement therebetween. For example, the connector portion and connection shaft may have complemental, non-circular, shapes (e.g., splined, polygonal, etc.) for rotatably fixing the components to one another.

The illustrated drive coupler 94 is configured to align the drive shaft 98 and connection shaft 45 of the drum end 34*b* on the common rotational axis A2 without permitting off-axis swinging of the shafts 45,98 relative to one another. (Those of ordinary skill in the art will appreciate off-axis swinging means positioning of the shaft at an angle (more than mere resilient deflection) relative to the rotational axis A1.) The illustrated drive coupler 94 is consequently configured to restrict swinging of a drive housing 126 of the frame 88 relative to the drum 34.

The frame 88 preferably includes the drive housing 126 and a power unit handle 128. Power unit handle 128 includes grips 72 configured to be grasped by a user to facilitate manual advancement of the concrete screed 32 in the forward direction D. The drive housing 126 is configured to operably support the powered drive 90. In the depicted embodiment, the power unit handle 128 of the frame 88 and the screed handle 36 can be manually manipulated by respective users so that the handles 36,128 can cooperatively advance the concrete screed 32.

Additional preferred details of the power unit 32 and screed handle 36 are disclosed in U.S. Pat. No. 10,837,147, issued Nov. 17, 2020, entitled CORDLESS ELECTRICALLY-POWERED CONCRETE SCREED, which is hereby incorporated in its entirety by reference herein.

Drum Sections

Turning to FIGS. 2-8, the rotatable concrete forming drum 34 presents a concrete-forming outer surface configured to engage concrete. As noted above, the drum 34 preferably includes drum sections 38, interconnecting adapters 40 located between adjacent drum sections 38, end adapters 42, and fasteners 44.

The illustrated drum sections 38 are interchangeably interconnectable in an end-to-end relationship to cooperatively form the rotatable concrete screed drum 34 being selectively variable depending on the drum sections 38 interconnected to form the drum 34. In the depicted embodiment, an adjacent pair of drum sections 38 may be attached end-to-end with an interconnecting adapter 40 and fasteners 44 to cooperatively form an interconnecting joint. Drum sections 38 may also be coupled with an end adapter 42 and fasteners 44 to form an endmost joint.

Drum sections 38 each present a central rotational axis A1 and the concrete-forming outer surface 50, which is configured to engage concrete as the drum 34 is rotated. The illustrated outer surface 50 comprises a surface of revolution defined about the rotational axis A1 of the respective drum section 38.

Again, the depicted drum sections 38 each preferably include the drum tube 46 and drum connectors 48. The drum tube 46 comprises a unitary cylindrical tube that presents the tube bore 54. Drum section 38 presents opposite connection ends 52 defined by the drum connectors 48.

In the illustrated embodiment, the opposite connection ends 52 of the drum section 38 are similarly constructed, such that each connection end 52 of one of the drum sections 38 is operable to interconnect with either of the connection ends 52 of any of the other the drum sections 38. However, for at least some aspects of the present invention, an alternative drum section may have connection ends that are not similarly constructed, as will be discussed below.

The preferred connection ends 52 are configured to be removably attached relative to the connection ends 52 of other drum sections 38 so that the connection ends 52 of each drum section 38 are interchangeable. Any one of the preferred drum sections 38 is operable to be removably attached relative to another one of the drum sections 38 to form an interconnecting joint by a respective pair of attached connection ends 52. Further, any one of the preferred drum sections 38 may also be removably attached to one of the end adapters 42.

As will be explained, the connection ends 52 each include an alignment element, with the alignment elements of interconnected connection ends 52 of adjacent drum sections 38 serving at least in part to align the rotational axes A1 of the adjacent drum sections 38, such that the drum has a common axis of rotation.

Figure 5:
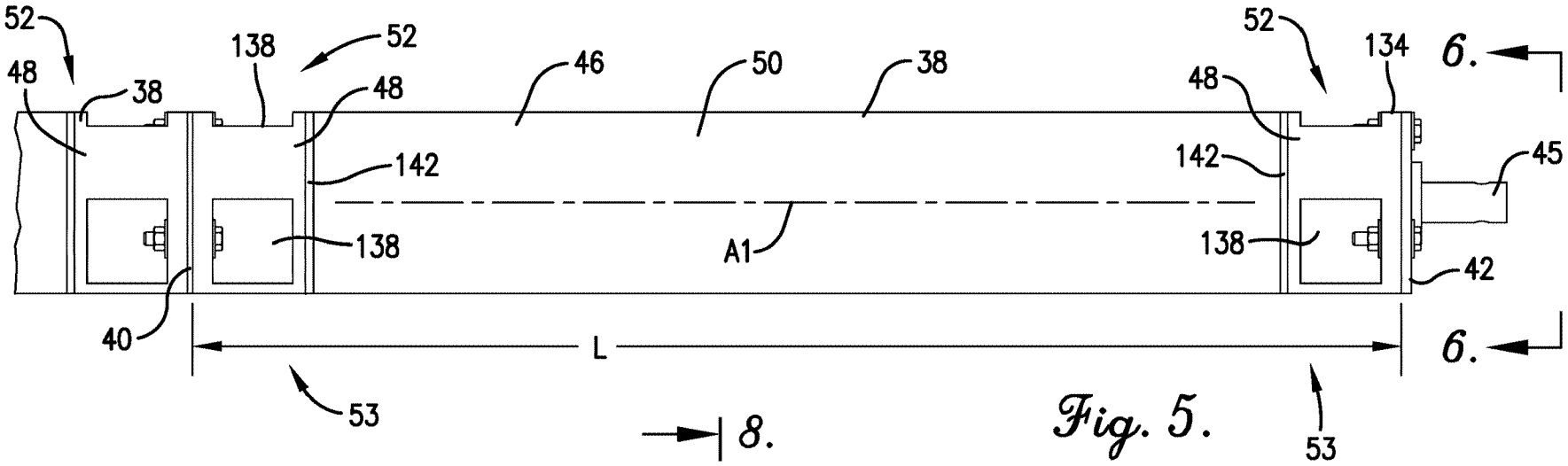
FIG. 5 is a fragmentary front elevation of the drum similar to FIG. 4, but showing the drum sections and adapters assembled with fasteners.

Drum sections 38 each present a drum section length dimension L (see FIG. 5). In the depicted embodiment, drum sections 38 have drum section lengths that are substantially equal. However, drum sections with various lengths may alternatively be provided according to certain aspects of the present invention.

Again, in the depicted embodiment, the drum tube 46 and drum connectors 48 cooperatively define the outer surface 50. The outer surface 50 is preferably cylindrical so that each drum section 38 preferably presents a constant diameter along the length thereof (see FIG. 7).

However, it is within the scope of the present invention for the outer surface of the drum section to have a diameter that varies along the length of the drum section. For instance, at least part of the outer surface of the drum section may have an outer diameter that increases and/or decreases in an axial direction. For instance, an outer surface portion may increase in diameter or decrease in diameter in a linear fashion, such that the outer surface portion has a tapered profile with a "slope" that is constant along the length of the outer surface portion. Similarly, an outer surface portion may increase in diameter or decrease in diameter in a non-linear fashion, such that the outer surface portion has a tapered profile with a "slope" that varies along the length of outer surface portion (e.g., where the tapered profile is curved and presents concave and/or convex segments).

When the illustrated drum sections 38 are attached to form the drum 34, the drum sections 38 have common diameters such that the entire drum 34 presents a constant diameter along the length thereof. However, it is within the scope of the present invention for the drum to have a diameter that varies along the length thereof. For instance, the outer surface of at least one drum section may have an outer diameter that increases and/or decreases in an axial direction. For instance, an outer surface of at least one drum section may increase in diameter and/or decrease. Any increase or decrease in diameter may be linear or non-linear, as discussed above. Of course, with the preferred embodiment, any variance in the diameter is limited to the section length between the connection ends so that the drum sections remain complete interchangeability.

As described above, drum connectors 48 preferably define respective connection ends 52 of the drum section 38. Each drum connector 48 includes a connector portion 130 and an insert portion 132 (see FIGS. 9 and 10). The connector portion 130 preferably includes a connector flange 134 and a central alignment opening 136 (see FIGS. 9 and 10). The connector portion 130 also presents a series of circumferentially spaced pockets 138 adjacent the connector flange 134 (see FIGS. 9 and 10).

In the depicted embodiment, each drum connector 48 is preferably fixed to a respective tube end 53 of the drum tube 46. More specifically, the insert portion 132 is inserted into a respective tube end 53 of the drum tube 46 so that the tube end 53 engages a shoulder 140 of the drum connector 48 along a seam 142 (see FIGS. 7 and 8).

The drum tube 46 and drum connector 48 are preferably formed of a metallic material. More preferably, the drum tube 46 and drum connector 48 are formed of aluminum, although one or both of these components may include, additionally or alternatively, another metallic material (e.g., carbon steel or stainless steel) or a synthetic resin material.

Preferably, the drum tube 46 and drum connector 48 are welded to each other along the seam 142. It is also within the ambit of the present invention for the drum tube and drum connector to be alternatively fixed relative to each other. Alternatively, certain aspects of the present invention contemplate the drum tube and drum connector being removably attached to one another.

For certain aspects of the present invention, the drum body need not include the drum tube. For instance, the drum body may have a solid, non-tubular construction (although the use of additional material may be less desirable due to the additional weight, additional costs, etc.). Furthermore, the drum tube and drum connectors may be integrally formed. For example, the connection ends may be machined at each end of the drum body (it will be appreciated that an integral, monolithic construction may be less desirable due to additional weight, additional costs, etc.).

Figure 7:
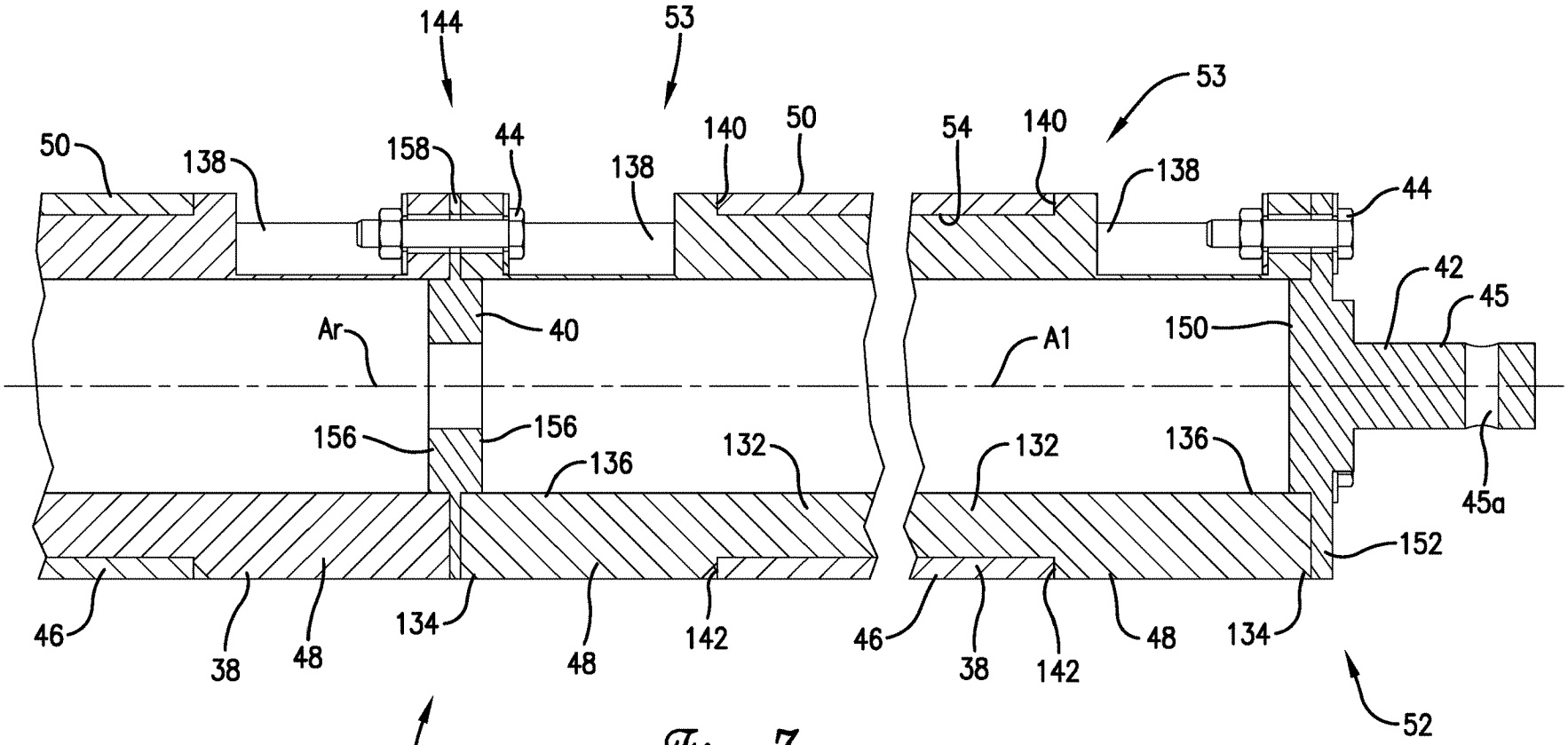
FIG. 7 is a fragmentary cross section of the drum taken along line 7-7 in FIG. 6, showing an elongated drum tube and drum connectors of the drum sections, with the interconnecting adapter being secured between respective drum connectors by fasteners and the end adapter being secured to another drum connector by fasteners.
Figure 8:
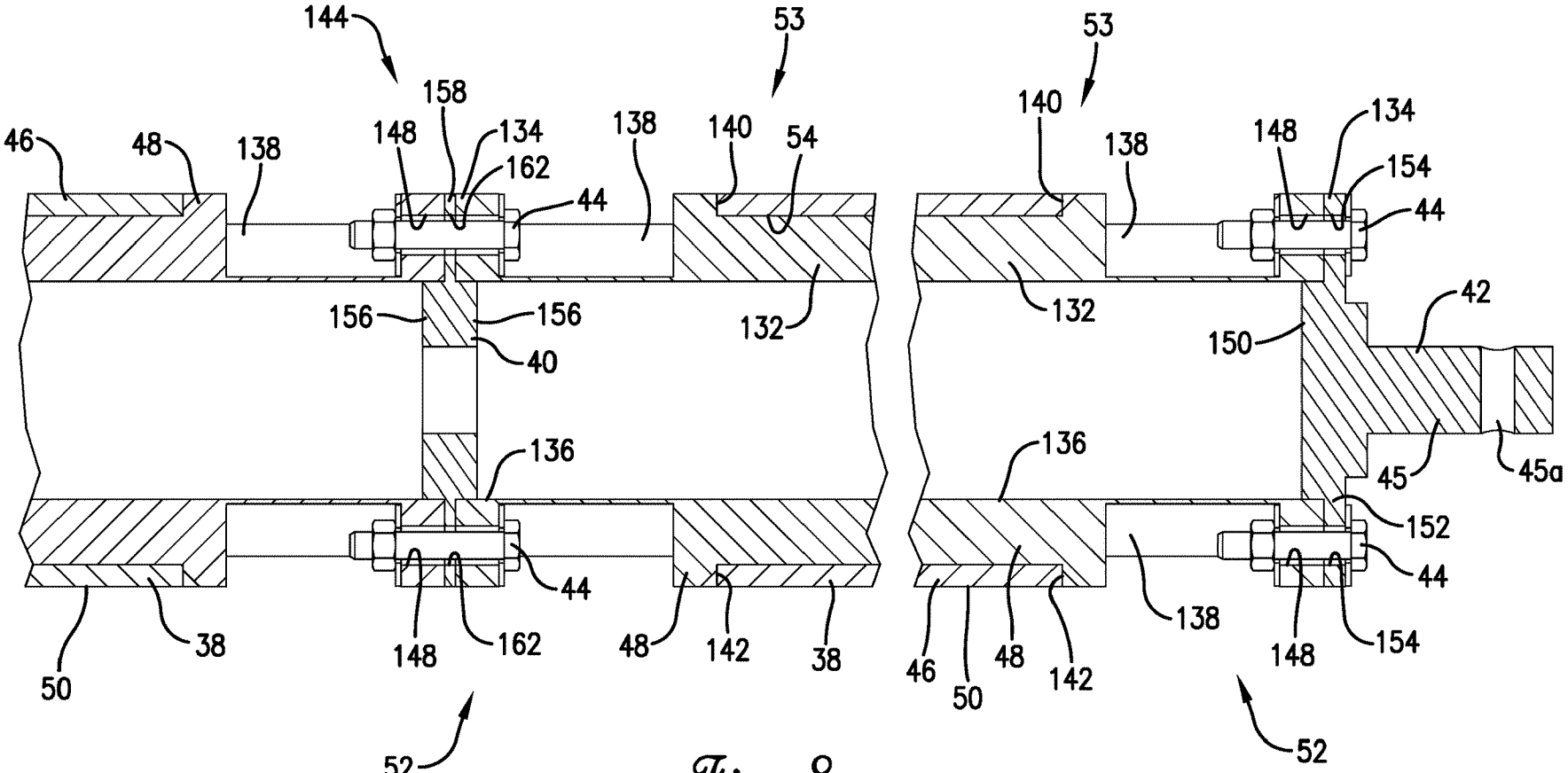
FIG. 8 is a fragmentary cross section of the drum assembly taken along line 8-8 in FIG. 6.

Connector flange 134 is configured for being removably attached relative to another connector flange 134, associated with another one of the drum sections 38, at an interconnecting joint 144 (see FIGS. 7 and 8). In the illustrated embodiment, each connector flange 134 may be attached to any one of the interconnecting adapters 40 or any one of the end adapters 42 with fasteners 44.

Fasteners 44 each preferably comprise threaded fasteners including a threaded bolt and a threaded nut. Although the connector flanges 134 are preferably removably attached relative to adapters 40,42 (and each other) by the depicted fasteners 44, alternative embodiments of the present invention may include alternative fastening elements for attaching a connection end relative to adapters and/or another connection end. For instance, alternative fasteners may include one or more non-threaded fastening elements, such as one or more of a pin, boss, clamp, lever, etc.

Figure 9:
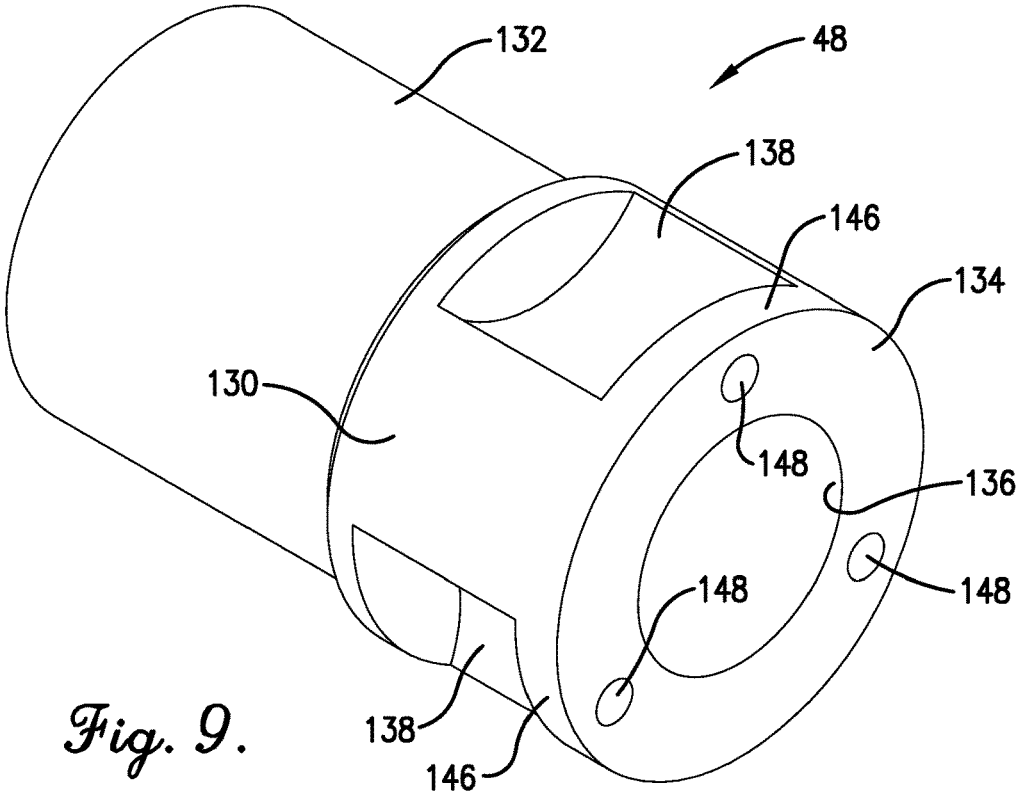
FIG. 9 is a perspective of a drum connector shown in FIGS. 1-8, showing a connector flange, an insert section, and fastener pockets of the drum connector, with the insert section configured to be inserted into the tube end of the drum tube.
Figure 10:
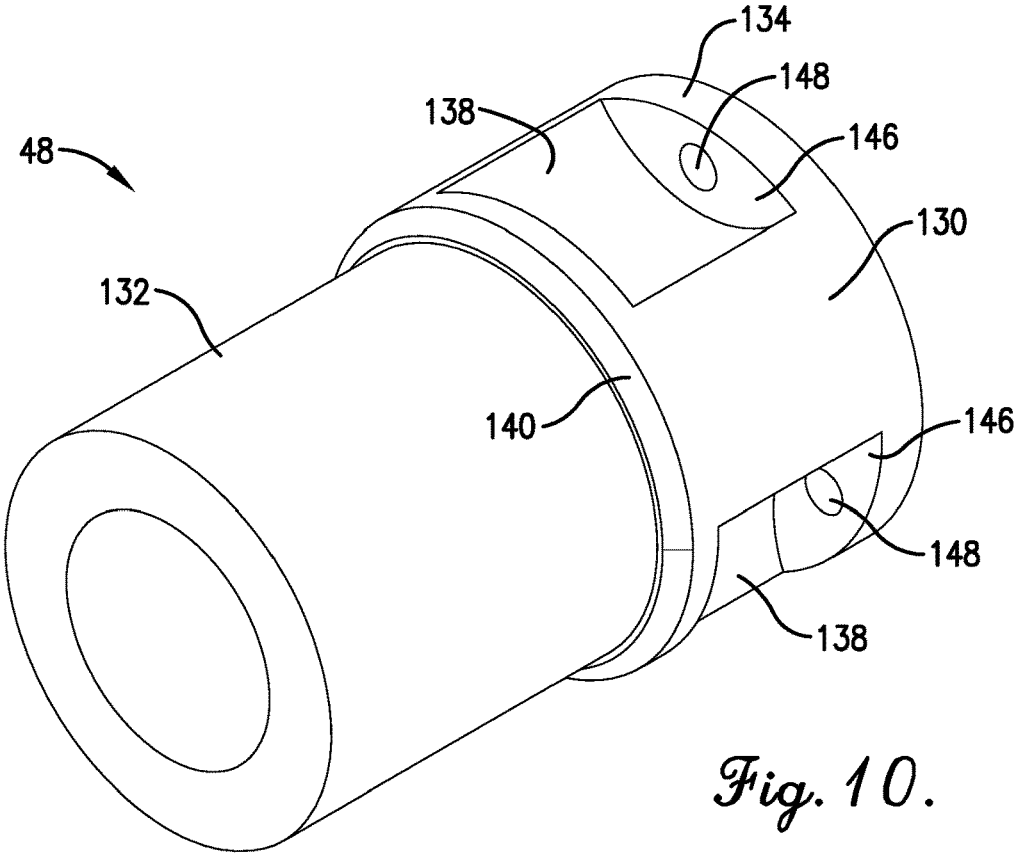
FIG. 10 is a perspective of the drum connector similar to FIG. 9, but taken from the opposite side.

Each connector flange 134 has a generally annular shape and includes flange sections 146 defined in part by respective pockets 138 (see FIGS. 9 and 10). Connector flange 134 also presents axially-extending fastener holes 148 that are spaced apart from each other and associated with the flange sections 146 and pockets 138 (see FIGS. 8-10).

The illustrated connector flange 134 preferably includes three (3) fastener holes 148 that each comprise a smooth circular opening (see FIG. 9). It is also within the scope of the present invention for one or more of the fastener holes to be alternatively shaped. For instance, one or more of the fastener holes may have an elongated, slotted profile instead of a circular profile (e.g., to facilitate alignment and connection of an adjacent adapter flange and an adjacent connector flange at an interconnecting joint).

Alternative embodiments of the drum connector may also have an alternative number of fastener holes (e.g., where the drum connector includes a single connector opening, two (2) fastener holes, four (4) fastener holes, or more than four (4) fastener holes). For at least some aspects of the present invention, one or more connector flanges may be devoid of openings (e.g., where the flange includes an integral fastener for engagement with the flange of an adjacent drum section).

In the depicted embodiment, connector flanges 134 of each drum connector 48 are interchangeably attachable with connector flanges 134 of other drum sections 38. The connector flanges 134 of the drum section 38 are similarly constructed, such that each connection end 52 of one of the drum sections 38 is operable to interconnect with either of the connection ends 52 of any of the other the drum sections 38.

However, for at least some aspects of the present invention, an alternative drum section may have connector flanges that are not similarly constructed, such that the drum section is not interchangeable. For instance, the flanges of a drum section may include respective male and female elements for engagement with the flanges of an adjacent drum section.

It will be appreciated that alternative flange configurations are within the scope of the present invention. For instance, as noted above, fastener holes of a flange may be alternatively configured. Alternative flange embodiments may also include an alternative annular shape (e.g., where the flange has a relatively larger or smaller radial thickness dimension, has axial projections and recesses (such that the flange has a non-flat configuration), etc.). For at least some aspects of the present invention, one or more drum connectors may include a connection structure other than a flange.

Again, drum connector 48 also presents fastener pockets 138 associated with the fastener holes 148 and the flange sections 146. Fastener pockets 138 are circumferentially spaced about the drum connector 48 and are provided as part of the corresponding connection end 52 (see FIGS. 7 and 8). The illustrated fastener pockets 138 are spaced equally about the rotational axis A1, although one or more pockets (and associated fasteners hole(s)) may be alternatively positioned relative to an adjacent pocket.

Each fastener pocket 138 is recessed radially inward relative to the outer surface 50 of the drum 34. More preferably, the pocket 138 comprises a scallop-shaped recess formed in the drum connector 48. Pockets 138 of each connection end 52 are also preferably spaced axially inward relative to the flange 134 of the connection end 52.

Preferably, the fastener holes are aligned with pockets 138 so that fasteners 44 can be inserted into and removed from the fastener holes 148 via the pockets 138. When the drum connector 48 is secured to an adapter by fasteners 44, the fasteners 44 each preferably extend through the flange 134 of the drum connector 48 and into corresponding pockets 138. For instance, fasteners 44 used to interconnect the connection ends 52 of adjacent drum sections 38 extend through the flanges 134 of the interconnected connection ends 52, through the adapter, and into corresponding ones of the pockets 138 of the interconnected connection ends 52.

It is also within the ambit of the present invention for one or more pockets to be alternatively configured. For instance, one or more pockets may present an alternative, recessed pocket shape. Alternative embodiments of the drum connector may also have an alternative number of pockets (e.g., where the drum connector includes a single pocket, two (2) pockets, four (4) pockets, or more than four (4) pockets, although the number of pockets and fasteners holes are preferably the same).

The connection ends 52 of the drum section 38 preferably have the same number and arrangement of fastener pockets, such that each connection end 52 of one of the drum sections 38 is operable to interconnect with either of the connection ends 52 of any of the other the drum sections 38. However, for at least some aspects of the present invention, an alternative drum section may have connection ends with different configurations of drum pockets.

Alignment openings 136 are each configured to provide a female alignment element operable for removable engagement with one of the interconnecting adapters 40 or one of the end adapters 42. In the depicted embodiment, the alignment opening 136 comprises a cylindrically shaped bore extending axially through the drum connector 48 and being coaxial with the rotational axis A1 of the drum section 38. As described below, the alignment opening 136 is configured to receive a projection of the respective adapter 40,42.

Again, the connection ends 52 each include the alignment opening 136. The alignment openings 136 of interconnected connection ends 52 of adjacent drum sections 38 serve at least in part to align the rotational axes A1 of the adjacent drum sections 38, such that the drum 34 has a common axis of rotation Ar (see FIGS. 2 and 7).

As will be described, the alignment openings 136 are configured to cooperate with an alignment projection of a respective adapter 40,42. In particular, the alignment projection and alignment opening 136 cooperatively define a male/female coupling where the alignment projection is removably received in the alignment opening 136.

It is also within the scope of the present invention for the drum connector (and/or another part of the drum) to have an alternative alignment element. For instance, the drum connector may alternatively include a male alignment element. For at least certain aspects of the present invention, the drum connector may alternatively include a male alignment element and a female alignment element, such that the drum connector is hermaphroditic. Again, most preferably, the connectors of all the drum sections would preferably have the same alternative configuration, although some aspects contemplate variances in connection ends.

Although the depicted alignment opening 136 is cylindrically shaped and presents a circular profile, it will be appreciated that the drum connector may be provided with an alternatively shaped alignment opening. For instance, the alignment openings may have a polygonal profile (e.g., where the profile is triangular, square, hexagonal, etc.) or splined profile that is shaped to receive a complementally shaped alignment element. For complemental alignment elements having a non-circular profile, such as a polygonal profile or splined profile, it will be understood that the alignment elements may engage one another to restrict relative rotation therebetween (e.g., to restrict relative rotation between the adjacent drum sections).

The illustrated alignment openings 136 are preferably axially aligned with the rotational axis A1 of the drum section 38. However, it is within the scope of certain aspects of the present invention for an alternative alignment element of the drum connector to be axially offset relative to the rotational axis A1. For instance, one or more alignment elements may be provided at axially offset locations as part of the flange.

In the depicted embodiment, alignment openings 136 of each drum connector 48 are interchangeably attachable with alignment structure of adapters 40,42. The alignment openings 136 of the drum section 38 are similarly constructed, such that each connection end 52 of one of the drum sections 38 is operable to interconnect with either of the connection ends 52 of any of the other the drum sections 38.

However, for at least some aspects of the present invention, an alternative drum section may have alignment elements that are not similarly constructed, such that the drum section is not interchangeable. For instance, the alignment elements of a drum section may include respective male and female elements for engagement with the alignment elements of an adjacent drum section.

As used herein, the terms "similarly constructed" and "interchangeably interconnectable" concern connection ends having an identical or substantially identical form, and connection ends having a substantially identical form may some have variances in form, so that any connection end may be attached with another connection end without any modification, reconfiguration, or other alterations and without the need for connection elements (e.g., adapters or fasteners) that are different than any of the other interconnection joints. For example, in alternative embodiments, an alternative one of the connection ends may have extra fastener holes and/or pockets, but the alternative connection end has the same fastener holes and pockets as another connection end, such that the connection ends have fastener holes and pockets needed for connection and are similarly constructed. Other "extra" features (such as projections, alternatively flange features, etc.) are also permissible in an alternative connection end as long as the extra features do not interfere with connecting the alternative connection end to another connection end.

Adapters

Turning to FIGS. 7, 8, 12, and 13, the end adapters 42 are operable for attaching one end of the drum 34 to the screed handle 36 or the power unit 32. End adapter 42 has a unitary construction and includes an alignment projection 150, adapter flange (or disc) 152, and the connection shaft 45.

The adapter flange 152 has a generally annular shape and presents axially-extending adapter holes 154 that are spaced apart from each other. The adapter flange 152 is operable to be oriented so that the adapter holes 154 of the adapter flange 152 are aligned with respective fastener holes 148 of the connector flange 134 to removably receive fasteners 44 (see FIG. 8).

The illustrated adapter flange 152 preferably includes three (3) adapter holes 154 that each comprise a smooth circular opening. It is also within the scope of the present invention for one or more adapter holes to be alternatively shaped. For instance, one or more adapter holes may have an elongated, slotted profile instead of a circular profile (e.g., to facilitate alignment and connection of the adapter flange and the adjacent connector flange). Alternative embodiments of the end adapter may also have an alternative number of adapter holes (e.g., where the end adapter includes a single adapter opening, two (2) adapter holes, four (4) adapter holes, or more than four (4) adapter holes).

The depicted alignment projections 150 each preferably comprise a cylindrically shaped projection for removable engagement with an alignment opening 136. In particular, the alignment projection 150 and alignment opening 136 cooperatively define a male/female coupling where the alignment projection 150 is removably received in the alignment opening 136.

The end adapter 42 is removably attached to one end of a respective drum section 38 with threaded fasteners 44 (see FIG. 8). In particular, the alignment projection 150 is inserted into the alignment opening 136 of the drum connector 38 so that the adapter flange 152 is engaged with the connector flange 134 of the drum connector 48. The adapter flange 152 and connector flange 134 are also oriented so that fasteners 44 can be inserted through the adapter holes 154 and the respective fastener holes 148.

The end adapters 42 may be removably attached to the coupler shaft 58 and drive coupler 94, respectively. In particular, the socket 82 of coupler shaft 58 slidably receives the connection shaft 45 of the end adapter 42 associated with drum end 34*a* (see FIG. 3). The socket 118 of the drive coupler 94 receives the connection shaft 45 of the end adapter 42 associated with drum end 34*b* (see FIG. 3).

Again, the pin 86 is inserted through the holes 84 of the coupler shaft 58 and the hole 45*a* of the connection shaft 45 to removably attach the connection shaft 45 and coupler shaft 58 to one another (see FIG. 3). The pin 112 is removably inserted through the fastener holes 124 and hole 45*a* to drivingly engage the coupler body 108 and the connection shaft 45.

In alternative embodiments, one or more end adapters may be alternatively configured for attachment to a respective drum section. For instance, one or more of the end adapters may include a structure other than the adapter flange for removable attachment to the drum connector (e.g., where an alternative drum connector does not include a connector flange).

Although the depicted alignment projection 150 is cylindrically shaped and presents a circular profile, it will be appreciated that the end adapter may be provided with an alternatively shaped alignment element. For instance, alternative alignment projections may have a polygonal profile (e.g., where the profile is triangular, square, hexagonal, etc.) that is shaped for engagement with a complementally shaped alignment opening. For complemental alignment elements having a non-circular profile, such as a polygonal profile, it will be understood that the alignment elements may engage one another to restrict relative rotation therebetween (e.g., to restrict relative rotation between the adjacent drum sections).

The illustrated alignment projections 150 are preferably axially aligned with the rotational axis A1 of the drum section 38. However, it is within the scope of certain aspects of the present invention for an alternative alignment element of the end adapter to be axially offset relative to the rotational axis A1. For instance, one or more alignment elements may be provided at axially offset locations as part of the flange of the end adapter.

The end adapters 42 are similarly constructed, such that each connection end 52 of one of the drum sections 38 is operable to be attached to any one of the end adapters 42. However, for at least some aspects of the present invention, multiple end adapters may not be similarly constructed. For instance, the alignment elements of multiple end adapters may include respective male and female elements for engagement with the alignment elements of corresponding drum sections.

In alternative embodiments, one or more end adapters may be alternatively configured for attachment to the handle and/or the power unit. For instance, one or more of the end adapters may include a structure other than a connection shaft for removable attachment to the handle and/or the power unit.

For at least certain aspects of the present invention, alternative embodiments of the drum may be devoid of an end adapter at one end of the drum. In one example, an endmost drum section of an alternative drum may have an integral end configured to be attached directly to the screed handle or the power unit.

Figure 11:
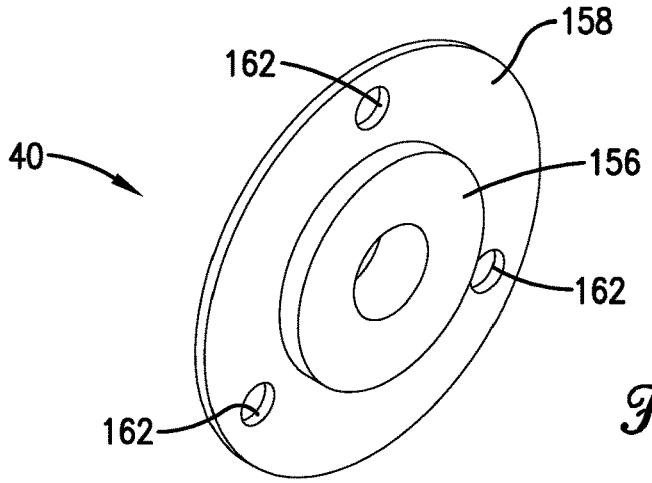
FIG. 11 is a perspective of the interconnecting adapter shown in FIGS. 4, 7, and 8, showing an adapter flange and alignment projections extending in opposite directions from the flange, with the projections configured to be inserted into respective drum connectors.
Figure 12:
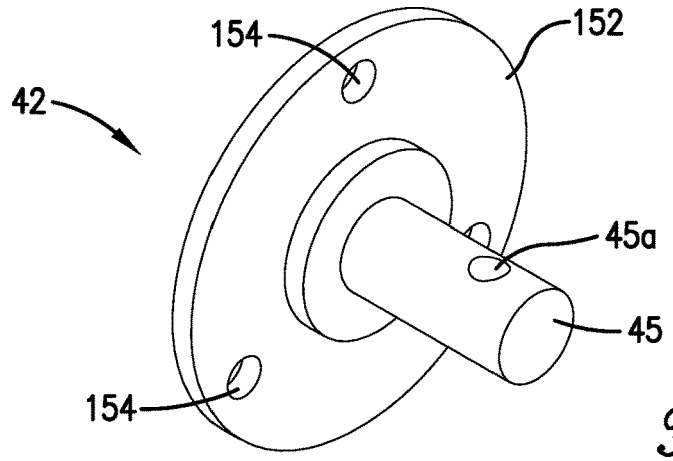
FIG. 12 is a perspective of the end adapter shown in FIGS. 3-8, with the end adapter including an adapter flange, an alignment projection configured to be inserted into a respective drum connector, and a connection shaft.
Figure 13:
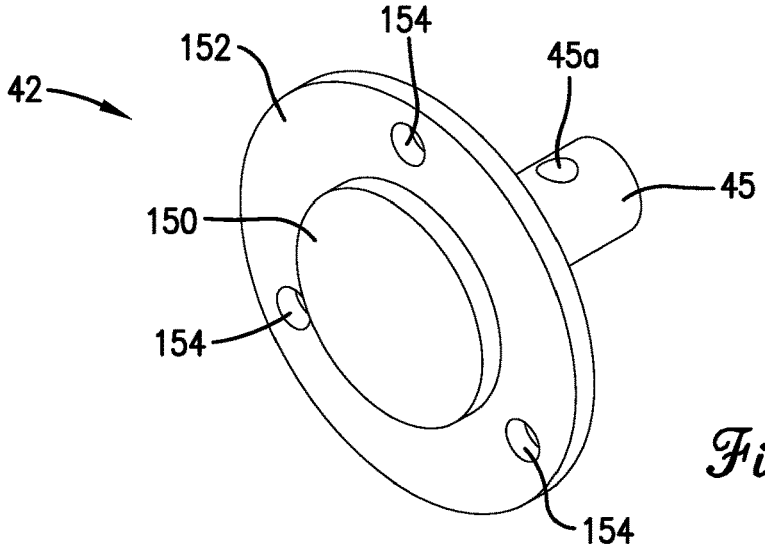
FIG. 13 is a perspective of the end adapter similar to FIG. 12, but taken from the opposite side of the adapter flange.
Figure 14:
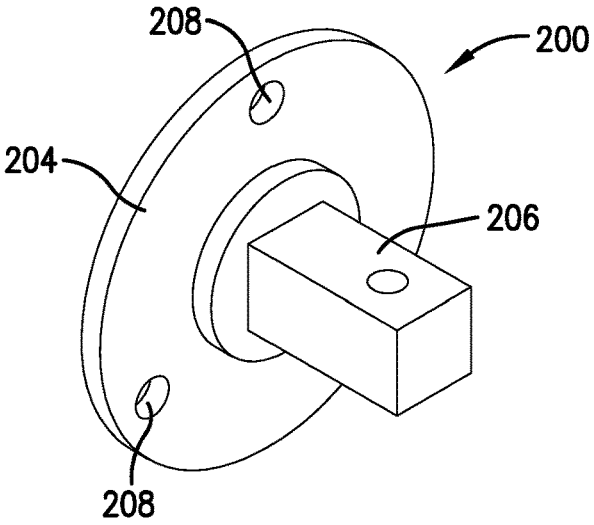
FIGS. 14 and 15 are perspective views of an alternative end adapter constructed in accordance with a second embodiment of the preferred invention.
Figure 15:
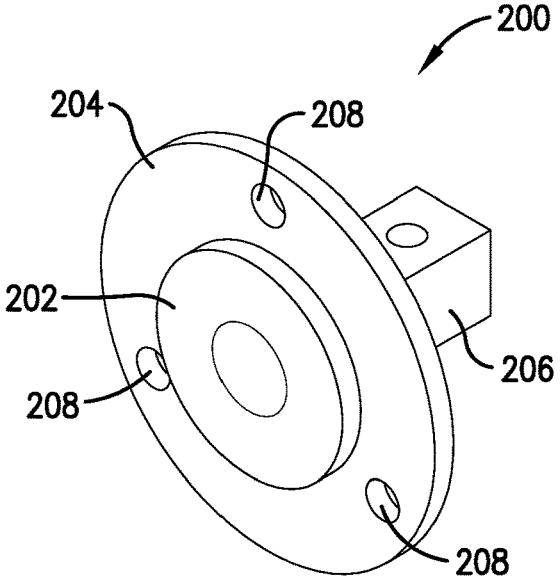
Figure 16:
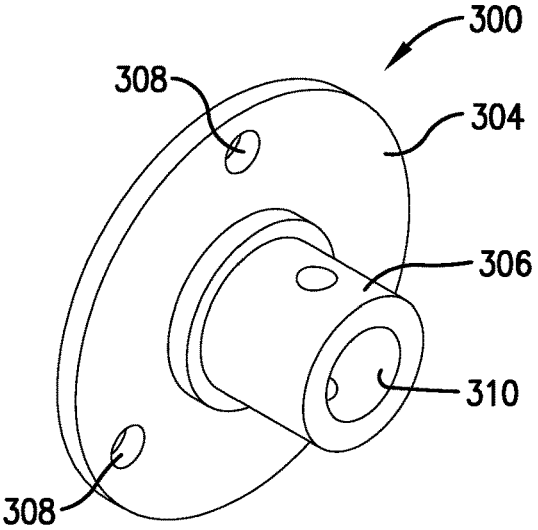
FIGS. 16 and 17 are perspective views of an alternative end adapter constructed in accordance with a third embodiment of the preferred invention.
Figure 17:
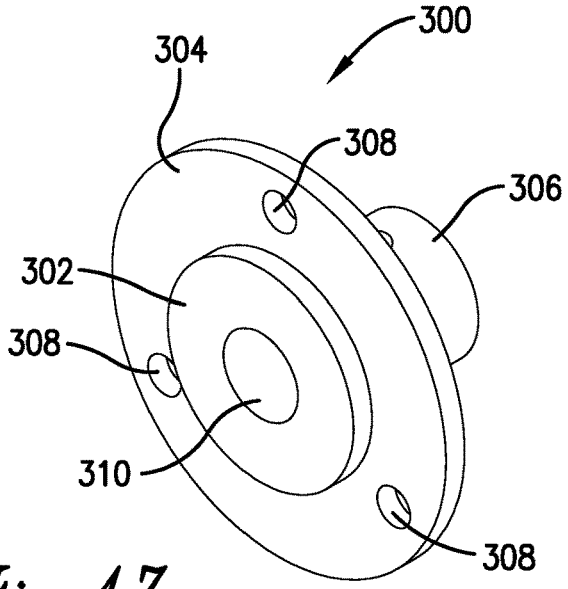

Turning to FIGS. 7, 8, and 11, the interconnecting adapters 40 are operable for attaching adjacent drum sections 38 in alignment with one another. In particular, the illustrated adapter 40 may be associated with the interconnected connection ends 52 of adjacent drum sections 38. The interconnecting adapter 40 has a unitary construction and includes a pair of opposite alignment projections 156 and an adapter flange (or disc) 158.

The adapter flange 158 has a generally annular shape and presents axially-extending adapter holes 162 that are spaced apart from each other. The adapter flange 158 is operable to be oriented so that the adapter holes 162 of the adapter flange 158 are aligned with respective fastener holes 148 of the connector flange 134 to removably receive fasteners 44 (see FIG. 8).

The illustrated adapter flange 152 preferably includes three (3) adapter holes 162 that each comprise a smooth circular opening. It is also within the scope of the present invention for one or more adapter holes of the interconnecting adapter to be alternatively shaped. For instance, one or more adapter holes may have an elongated, slotted profile instead of a circular profile (e.g., to facilitate alignment and connection of the adapter flange and the adjacent connector flange). Alternative embodiments of the interconnecting adapter may also have an alternative number of adapter holes (e.g., where the end adapter includes a single adapter opening, two (2) adapter holes, four (4) adapter holes, or more than four (4) adapter holes).

The depicted alignment projections 156 each preferably comprise a cylindrically shaped projection for removable engagement with an alignment opening 136. In particular, the alignment projection 156 and alignment opening 136 cooperatively define a male/female coupling where the alignment projection 156 is removably received in the alignment opening 136.

Preferably, the adapter flange (or disc) 158 is interposed between flanges 134 of the interconnected connection ends 52 of the adjacent drum sections 38. The interconnecting adapter 40 is removably attached to connection ends 52 of adjacent drum sections 38 with threaded fasteners 44 (see FIG. 8). In particular, one of the alignment projections 156 is inserted into the alignment opening 136 of one drum connector 48 so that the adapter flange 158 is engaged with the connector flange 134 of the drum connector 48. The other alignment projection 156 of the adapter 40 is inserted into the alignment opening 136 of the adjacent drum connector 48 so that the adapter flange 158 is engaged with the connector flange 134 of the adjacent drum connector 48. The adapter flange 158 and connector flanges 134 are also oriented so that fasteners 44 may be inserted through the adapter holes 162 and the respective fastener holes 148 (see FIG. 8). The inserted fasteners 44 preferably interconnect the flange 158 and flanges 134 of the interconnected connection ends 52 of the adjacent drum sections 38.

In the illustrated embodiment, the alignment projections 156 of the adapter 40 cooperate with the alignment openings 136 of the interconnected connection ends 52 of adjacent drum sections 38 to align the rotational axes A1 of adjacent drum sections 38 (see FIG. 8). Thus, the alignment projections 156 and alignment openings 136 of the interconnected connection ends 52 of adjacent drum sections 38 cooperatively define male/female couplings where the alignment projections 156 are removably received in respective alignment openings 136.

In alternative embodiments, one or more interconnecting adapters may be alternatively configured for attachment to respective drum sections. For instance, one or more of the interconnecting adapters may include a structure other than the adapter flange for removable attachment to the drum connectors (e.g., where an alternative drum connector does not include a connector flange).

Alternative embodiments of the interconnecting adapters may include an alternatively shaped alignment projection. It is also within the scope of the present invention for the interconnecting adapter to have an alternative alignment element. For instance, an alternative interconnecting adapter may include female alignment elements configured for use with alternative male alignment structure of the connection ends of alternative drum sections. That is, alternative embodiments of the adapter and drum section may include an alternative male/female coupling for relative alignment of the adapter and drum section. For instance, an alternative drum section may include a male alignment projection and an alternative adapter may include a female alignment opening. For at least certain aspects of the present invention, the interconnecting adapter may include a male alignment element and a female alignment element, such that the interconnecting adapter is hermaphroditic.

Although the illustrated alignment projection 156 is cylindrically shaped and presents a circular profile, it will be appreciated that the interconnecting adapter may be provided with an alternatively shaped alignment element. For instance, the alignment projections may have a polygonal profile (e.g., where the profile is triangular, square, hexagonal, etc.) that is shaped for engagement with a complementally shaped alignment opening. For complemental alignment elements having a non-circular profile, such as a polygonal profile, it will be understood that the alignment elements may engage one another to restrict relative rotation therebetween (e.g., to restrict relative rotation between the adjacent drum sections).

The illustrated alignment projections 156 are preferably axially aligned with the rotational axis A1 of the drum section 38. However, it is within the scope of certain aspects of the present invention for an alternative alignment element of the interconnecting adapter to be axially offset relative to the rotational axis A1. For instance, one or more alignment elements may be provided at axially offset locations as part of the flange of the interconnecting adapter.

The interconnecting adapters 40 are similarly constructed, such that each connection end 52 of one of the drum sections 38 is operable to interconnect with any one of the interconnecting adapters 40. However, for at least some aspects of the present invention, an alternative interconnecting adapter may not be similarly constructed. For instance, the alignment elements of multiple interconnecting adapters may alternatively include respective male and female elements for specific engagement with the alignment elements of only certain corresponding drum sections.

For at least certain aspects of the present invention, alternative embodiments of the drum may be devoid of an interconnecting adapter between adjacent drum sections. In one example, drum sections may have drum connectors that are configured for removable, direct connection with each other. For instance, alternative drum connectors may include complemental male and female connector elements that are directly and removably engaged with one another. It is also possible according to certain aspects of the present invention for adjacent drum sections 38 to be directly interconnected with only the fasteners 44, without the use of the adapter 40.

In use, drum sections 38 are interchangeably interconnectable with the interconnecting adapters 40 so that the drum sections 38 are arranged in an end-to-end relationship to cooperatively form the drum 34. The illustrated drum 34 is selectively variable depending on the drum sections 38 interconnected by adapters 40 to form the drum 34. With illustrated drum sections having the same diameter, the drum varies only in length. However, with alternative drum sections (with varying diameters), the drum profile may also be varied.

Preferably, the drum 34 is constructed with drum sections 38 that each have a concrete-forming outer surface 50 to engage concrete as the drum 34 is rotated. However, as noted above, alternative drum embodiments may include a drum section (or other drum element) located along the length of the drum that does not form concrete as the drum is rotated. For example, alternative drum embodiments may include one or more spacer elements to connect concrete-forming drum sections and space such concrete-forming drum sections apart. It will be appreciated that a spacer that does not form concrete may be provided as a drum section and/or as an adapter.

The screed assembly 30 is formed by removably attaching drum ends 34*a,b* to the screed handle 36 and power unit 32, respectively. In particular, coupler shaft 58 receives the connection shaft 45 of drum end 34*a* and is secured thereto by the pin 86. Similarly, the drive coupler 94 receives the connection shaft 45 of drum end 34*b* and is secured thereto by the pin 112. With the screed assembly 30 assembled, the power unit 32 may be selectively engaged by a user to drivingly rotate the entire drum 34 as a unit.

With the interchangeability and similar construction associated with the illustrated connection ends and flanges, the drum 34 is preferably formed by any selection of drum sections 38 and adapters 40,42. Furthermore, any drum section 38 is capable of being connected to the power unit 32 or the screed handle 36.

ALTERNATIVE EMBODIMENTS

Turning to FIGS. 14-17, alternative embodiments of end adapters are depicted. For the sake of brevity, the remaining description will focus primarily on the differences of these alternative embodiments from the preferred embodiment described above.

An alternative end adapter 200 (see FIGS. 14 and 15) is constructed in accordance with a second embodiment of the present invention and includes an alignment projection 202, an adapter flange 204, and a connection shaft 206. Flange 204 presents adapter holes 208. Connection shaft 206 presents a generally square end profile and is configured to be received in a complementally-shaped socket having a square end profile.

An alternative end adapter 300 (see FIGS. 16 and 17) is constructed in accordance with a third embodiment of the present invention and includes an alignment projection 302, an adapter flange 304, and a connection shaft 306. Flange 304 presents adapter holes 308. The end adapter 300 also presents a bore 310 that extends continuously through the projection 302 and the shaft 306. Connection shaft 306 has a tubular construction that is configured to receive a complementally-shaped shaft having a circular end profile.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

The invention claimed is:

1. A concrete screed assembly comprising:

a plurality of elongated drum sections interchangeably interconnectable in an end-to-end relationship to cooperatively form a rotatable concrete screed drum, said drum sections each presenting a concrete-forming outer surface configured to engage concrete as the drum is rotated, said drum sections each including opposite connection ends, said connection ends each including an alignment element; and an adapter interposed between a corresponding pair of the connection ends of adjacent drum sections, said adapter including alignment structure that engages the alignment elements of the corresponding pair of connection ends, with the alignment structure of the adapter and each engaged alignment element cooperatively defining an interengaging male/female coupling.

2. The concrete screed assembly as claimed in claim 1, said outer surface of each drum section being cylindrical, said drum sections having common diameters such that the drum presents a constant diameter along the length thereof.

3. The concrete screed assembly as claimed in claim 1, said drum sections being equal in length.

4. The concrete screed assembly as claimed in claim 1, further comprising:

a power unit, said power unit including a drive housing and a powered drive operably supported by the drive housing, said powered drive including a rotatable drive shaft drivingly connected to the drum.

5. The concrete screed assembly as claimed in claim 1, said drum sections each presenting a central rotational axis, said alignment structure cooperating with the alignment elements of the corresponding pair of connection ends to align the rotational axes of the adjacent drum sections, such that the drum has a common axis of rotation.

6. The concrete screed assembly as claimed in claim 5, each of said male/female couplings having one of the alignment element and the alignment structure received in the other of the alignment element and the alignment structure.

7. The concrete screed assembly as claimed in claim 6, one of said alignment element and said alignment structure being a cylindrically shaped opening and the other of said alignment element and said alignment structure being a cylindrically shaped projection received in the opening, said projection and said opening being coaxial with the rotational axes of the adjacent drum sections.

8. The concrete screed assembly as claimed in claim 6, said connection ends being similarly constructed, such that each connection end of one of the drum sections is operable to interconnect with either of the connection ends of any of the other the drum sections.

9. The concrete screed assembly as claimed in claim 8, said alignment structure comprising a pair of oppositely extending male projections, each of said alignment elements comprising a female alignment opening.

10. The concrete screed assembly as claimed in claim 1, each of said connection ends including a flange, said adapter including a disc interposed between the flanges of the corresponding pair of connection ends of the adjacent drum sections.

11. The concrete screed assembly as claimed in claim 10, further comprising:

a fastener interconnecting the disc of the adapter and the flanges of the corresponding pair of connection ends of the adjacent drum sections.

12. The concrete screed assembly as claimed in claim 1, said drum sections each including an elongated tube presenting opposite tube ends, said drum sections each including a pair of end connectors defining respective connection ends of the drum section, said end connectors each being fixed to a respective one of the tube ends, said tube and said end connectors cooperatively defining the outer surface of the drum section.

13. The concrete screed assembly as claimed in claim 12, said drum connectors each including an insert portion received in the respective one of the tube ends.

14. A concrete screed assembly comprising:

a plurality of elongated drum sections interchangeably interconnectable in an end-to-end relationship to cooperatively form a rotatable concrete screed drum being selectively variable depending on the drum sections interconnected to form the drum, said drum sections each presenting a concrete-forming outer surface configured to engage concrete as the drum is rotated, said drum sections each including opposite connection ends that are similarly constructed, such that each connection end of one of the drum sections is operable to interconnect with either of the connection ends of any of the other the drum sections.

15. The concrete screed assembly as claimed in claim 14, further comprising:

a power unit, said power unit including a drive housing and a powered drive operably supported by the drive housing, said powered drive including a rotatable drive shaft drivingly connected to the drum.

16. The concrete screed assembly as claimed in claim 14, said drum sections each presenting a central rotational axis, said connection ends each including an alignment element, with the alignment elements of interconnected connection ends of adjacent drum sections serving at least in part to align the rotational axes of the adjacent drum sections, such that the drum has a common axis of rotation.

17. The concrete screed assembly as claimed in claim 16, further comprising:

an adapter associated with the interconnected connection ends of the adjacent drum sections, said adapter including alignment structure cooperating with the alignment elements of the interconnected connection ends of the adjacent drum sections to align the rotational axes of the adjacent drum sections.

18. The concrete screed assembly as claimed in claim 17, said alignment element of each of the connection ends and said alignment structure of the adapter cooperatively defining a male/female coupling, wherein one of the alignment element and the alignment structure is received in the other of the alignment element and the alignment structure.

19. The concrete screed assembly as claimed in claim 18, one of said alignment element and said alignment structure being a cylindrically shaped opening and the other of said alignment element and said alignment structure being a cylindrically shaped projection received in the opening, said projection and said opening being coaxial with the rotational axes of the adjacent drum sections.

20. The concrete screed assembly as claimed in claim 17, each of said connection ends including a flange, said adapter including a disc interposed between the flanges of the interconnected connection ends of the adjacent drum sections.

21. The concrete screed assembly as claimed in claim 20, further comprising:

a fastener interconnecting the disc of the adapter and the flanges of the interconnected connection ends of the adjacent drum sections.

22. The concrete screed assembly as claimed in claim 14, said outer surface of each drum section being cylindrical, said drum sections having common diameters such that the drum presents a constant diameter along the length thereof.

23. The concrete screed assembly as claimed in claim 14, said drum sections being equal in length.

24. The concrete screed assembly as claimed in claim 14, said drum sections each including an elongated tube presenting opposite tube ends, said drum sections each including a pair of end connectors defining respective connection ends of the drum section, said end connectors each being fixed to a respective one of the tube ends, said tube and said end connectors cooperatively defining the outer surface of the drum section.

25. The concrete screed assembly as claimed in claim 24, said drum connectors each including an insert portion received in the respective one of the tube ends.

* * * * *